US006281254B1

(12) United States Patent
Nakajima et al.

(10) Patent No.: US 6,281,254 B1
(45) Date of Patent: Aug. 28, 2001

(54) MICROCHANNEL APPARATUS AND METHOD OF PRODUCING EMULSIONS MAKING USE THEREOF

(75) Inventors: Mitsutoshi Nakajima; Hiroshi Nabetani; Yuji Kikuchi; Christophe Largueze, all of Ibaraki (JP)

(73) Assignees: Japan as represented by Director of National Food Research Institute, Ministry of Agriculture, Forestry and Fisheries, Ibaraki; Bio-oriented Technology Research Advancement Institution, Tokyo, both of (JP)

( * ) Notice: Subject to any disclaimer, the term of this patent is extended or adjusted under 35 U.S.C. 154(b) by 0 days.

(21) Appl. No.: 09/260,417

(22) Filed: Mar. 1, 1999

(30) Foreign Application Priority Data

Sep. 17, 1998 (JP) ..... 10-262849

(51) Int. Cl.[7] ..... B01F 3/08; B01F 5/06

(52) U.S. Cl. ..... 516/53; 137/3; 137/896; 210/800; 366/173.1; 366/176.1; 366/176.4; 366/340; 516/924

(58) Field of Search ..... 516/73, 924, 53; 366/173.1, 176.1, 176.4, 340, 341; 210/800; 137/3, 7, 896; 514/937, 941; 264/11

(56) References Cited

U.S. PATENT DOCUMENTS 4,201,691 * 5/1980 Asher et al. ..... 516/924 X
4,533,254 * 8/1985 Cook et al. ..... 366/176.1
5,247,957 * 9/1993 Weisse ..... 137/3
5,326,484 * 7/1994 Nakashima et al. ..... 366/340 X
5,730,187 * 3/1998 Howitz et al. ..... 137/896 X
5,842,787 * 12/1998 Kopf-Sill et al. ..... 366/340
5,904,424 * 5/1999 Schwesinger et al. ..... 366/340 X

FOREIGN PATENT DOCUMENTS 295433 4/1990 (JP) .
9-225291 * 2/1997 (JP) .
WO30783 8/1997 (WO) .

OTHER PUBLICATIONS

E.S.R. Gopal, "Science Of Emulsions", Asakura–shoten 1971.
F. Olson et al., "Preparation Of Liposomes Of Defined Size Distribution By Extrusion Through Polycarbonate Membranes", *Biochimica et Biophysica Acta*, 557 (1979) 9–23, Elsevier/North–Holland Biomedical Press.
"Kagaku Kogaku", vol. 21, No. 4, 1957.
"Method Of Using Repeated Filtrations Through A PTFE Membrane", Proceedings of the 26th Autumn Meeting of the Society of Chemical Engineers, p. 243, 1993.

* cited by examiner

*Primary Examiner*—Richard D. Lovering
(74) *Attorney, Agent, or Firm*—Carrier, Blackman & Associates, P.C.; Jpseph P. Carrier; William D. Blackman

(57) ABSTRACT

A microchannel apparatus includes a plural partition walls 4 formed as extensions of plural microchannels 1 toward a continuous phase, and a flow path 5 is formed between adjacent ones of the partition walls 4. A dispersed phase pumped into a continuous phase via each microchannel 1 generates nearly perfect spheres in the course of passing through the microchannel and the flow path 5 in between the partition walls 4, thereby producing emulsions comprising fine and homogenous microspheres.

14 Claims, 9 Drawing Sheets

(a)

(b)

(a)

(b)

( a )

( b )

MICROCHANNEL APPARATUS AND METHOD OF PRODUCING EMULSIONS MAKING USE THEREOF

BACKGROUND OF THE INVENTION

1. Field of the Invention

The present invention relates to a microchannel apparatus for producing emulsions used in the food industry, the manufacturing of drugs and cosmetics, etc., and to a method of producing emulsions making use thereof.

2. Description of Related Art

Techniques in which a biphasic system, for which a separated state is thermodynamically stable, is formed, such as that composed of a water phase and an organic phase which are emulsified to obtain a semi-stable emulsion, are conventionally known. As general emulsification methods, there have been described in "Science of Emulsions" (Asakura-shoten, 1971), the methods of using a mixer, a colloid mill, a homogenizer, etc., and the method of dispersion with sound waves, which are all well-known.

The general methods mentioned above have a disadvantage in that diameters of dispersed phase particles in a continuous phase are distributed over a wide range.

Therefore, a method of using filtration by means of a membrane comprising polycarbonate (Biochemica et Biophysica Acta, 557 (1979), North Holland Biochemical Press); a method using repeated filtrations through a PTFE (polytetrafluoroethylene) membrane (Proceedings of the 26th Autumn Meeting of the Society of Chemical Engineers, Japan, 1993); and, a method of manufacturing homogenous emulsions by transferring a dispersed phase into a continuous phase through a porous glass membrane having uniform pores (Japanese Patent Application Laid-Open No. 2-95433), have been proposed.

As a method of producing emulsions using a nozzle or a porous plate, a laminar-flow dripping method (KAGAKU KOOGAKU Vol. 21, No. 4, 1957) is also known.

The method using filtration through a membrane comprising polycarbonate and the method using repeated filtrations through a PTFE membrane theoretically cannot manufacture emulsions comprising particles larger than the membrane pores and cannot separate particles smaller than the membrane pores. These methods are, therefore, especially unsuitable for producing emulsions comprising large particles. In addition, these methods using a membrane are unsuitable for industrially mass producing emulsions.

In the method using a porous glass membrane having uniform pores, when the average diameter of the membrane pores is small, particle diameters are distributed in a narrow range and thus homogenous emulsions can be obtained. When the average diameter of the membrane pores is increased, however, particle diameters become distributed over a wide range so that homogenous emulsions cannot be obtained. In addition, in the laminar-flow dripping method, particle sizes become 1,000 $\mu$m or more and are distributed over a wide range so that homogenous emulsions cannot be obtained.

Therefore, the inventors of the present invention formerly proposed an apparatus which can produce homogenous emulsions continuously in International Publication No. WO97/30783.

The structure of this apparatus is shown in FIGS. 10 and 11. FIG. 10 is a vertical sectional view of this apparatus and FIG. 11 shows a base and a plate taken apart.

In this apparatus for producing emulsions, a supply port 101 for a continuous phase (W) is formed in a side wall of a body 100, a supply port 103 for a dispersed phase (O) is formed in the center of a lid 102 which closes an upper opening of the body 100, and a withdrawal ports 104 for emulsions (E) are formed at a place apart from the center. A bulkhead member 106 formed between the lid 102 and the base 105 separates the supply port 103 for the dispersed phase (O) from the withdrawal ports 104 for emulsions (E). In addition, a supply port 107 for the dispersed phase (O) is formed in the center part of the base 105, a gap 109 is formed between the base 105 and the plate 108 placed opposite the base 105, a boundary section 110 formed in the base 105 separates the dispersed phase (O) and the continuous phase (W), and via a microchannel 111 formed in the boundary section 110 the dispersed phase (O) and the continuous phase (W) are mixed.

The dispersed phase (O) supplied to the inside of the bulkhead member 106 via the supply port 103 enters the gap 109 between the plate 108 and the base 105 via the supply port 107 and this dispersed phase (O) enters the continuous phase (W) through the microchannels in the boundary section 110, thereby forming emulsions.

In addition, the inventors of the present invention have proposed other microchannel apparatuses, as improvements of the apparatus disclosed in International Publication No. WO97/30783, in Japanese Patent Application Nos. 10-83946 and 10-187345.

In the apparatus proposed in Japanese Patent Application No. 10-83946, emulsions are easily withdrawn by orienting the apparatus shown in FIG. 10 in a vertical direction or inclined and using differences in specific gravity between the dispersed phase and the continuous phase. The apparatus proposed in Japanese Patent Application No. 10-187345 is a cross-flow apparatus which pumps the dispersed phase into the continuous phase continuously flowing from one side and it is very effective for continuously producing emulsions.

FIG. 12 is an enlarged view of the microchannel part of the apparatus disclosed in International Publication No. WO97/30783, as well as in Japanese Patent Application Nos. 10-83946 and 10-187345.

The microchannels 111 are formed between convex portions 112. Because of the differences in size of each microchannel and the positions in which microchannels are formed, the pressure to obtain break-through (i.e. pressure at which production of microspheres starts) differs in each microchannel.

Accordingly, as shown in FIG. 12, of the base, in the case of applying low pressure to the dispersed phase, microspheres (fine particles of dispersed phase) are formed only in one or another specific microchannel, so as to obtain very homogenous microspheres. However, it is unsuitable for mass production because the rest and indeed most of the microchannels do not take part in producing the microspheres.

On the other hand, as shown in FIGS. 13(*a*) and 13(*b*), in the case of applying considerably high pressure to the dispersed phase in order to produce microspheres from all microchannels in the previously proposed apparatus, to make mass production more efficient, adjacent microspheres connect and unite with each other, so as to grow large.

SUMMARY OF THE INVENTION

The inventors achieved the present invention based on their determination that microspheres in the course of growing, i.e. which have not become perfect spheres yet, can easily unite with each other when they connect or come into contact, and conversely microspheres which have already become perfect spheres have difficulty in uniting to each other even if they should connect.

Therefore, there is provided in accordance with the present invention a microchannel apparatus, comprising: a plurality of microchannels having a predetermined width formed in a boundary section between a dispersed phase region and a continuous region phase in which the dispersed phase may be pumped into the continuous phase via said microchannels to form microspheres; wherein said microchannels are formed between fine convex portions and a partition wall is formed from at least one said convex portions toward the continuous phase.

The microspheres tend not to unite with each other because microspheres pumped from a microchannel will not connect to microspheres pumped from an adjacent microchannel on the condition that the microspheres have become nearly perfect spheres, due to the presence of the partition wall. Accordingly, it is possible to mass produce homogenous and fine microspheres.

There is also provided in accordance with the present invention, a microchannel apparatus as the application of the form of microchannels defined in above to the cross-flow apparatus proposed in Japanese Patent Application No. 10-187345, comprising: a base which is accommodated in a case and a plate which is installed on a side of the base for forming a flow path beside the base, wherein a supply hole for a continuous phase, a supply hole for a dispersed phase, and a withdrawal hole for emulsions are formed in the case, and in the base are formed, a supply port for the continuous phase corresponding to the supply hole for the continuous phase, a withdrawal port for emulsions corresponding to the withdrawal hole for emulsions, and microchannels opening to the flow path.

There is further provided in accordance with the present invention, a microchannel apparatus as the application of the form of microchannels defined above to the apparatus proposed in International Publication No. WO97/30783, comprising: a base in which a supply port for a dispersed phase is formed, a gap to which the dispersed phase is supplied formed between the base and a plate placed opposite the base, and a boundary section that is formed between the dispersed phase and a continuous phase on the side of the base opposing to the plate, wherein in the boundary section microchannels for feeding the dispersed phase into the continuous phase are formed.

There is provided in accordance with yet another aspect of the present invention, a microchannel apparatus as the application of the form of microchannels defined above to the cross-flow apparatus proposed in Japanese Patent Application No. 10-83946, comprising: a base oriented in a vertical direction or inclined, a plate placed opposite the base, a supply port for a dispersed phase formed in the base and a boundary section formed on the side of the base opposing to the plate for dividing the space to which the dispersed phase is supplied and the space to which a continuous phase is supplied, wherein microchannels having a predetermined width are formed in a position from which fine particles of the dispersed phase can be withdrawn by floating and sinking in response to their specific gravity.

The above-mentioned apparatus according to the invention, may alternatively be used to separate the dispersed and the continuous phases of an emulsion via the microchannels, for example, by supplying the emulsion into the apparatus from the hole normally used for withdrawal of the emulsions during an emulsion manufacturing process, and applying pressure.

It is possible to externally observe the production of emulsions with a CCD camera by making the plate transparent, i.e., by employing a glass plate or the like. It is also possible to form microchannels through mechanical cutting and shaving, however, it is preferable to adopt a wet etching process or a dry etching process which makes use of the photolithography technique in order to produce fine microchannels of the base.

DETAILED DESCRIPTION OF THE PRESENTLY PREFERRED EMBODIMENTS

Figure 1:
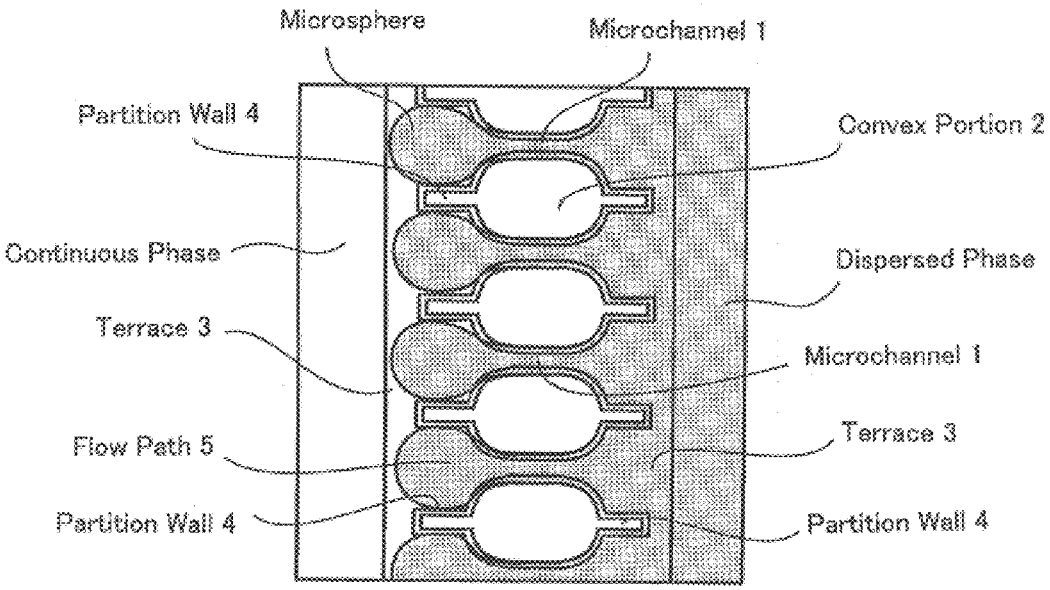
FIG. 1(*a*) is a plan view of a representation of microchannels in an apparatus according to a preferred embodiment of the present invention and FIG. 1(*b*) is an enlarged photograph on which FIG. 1(*a*) is based.
Figure 1:
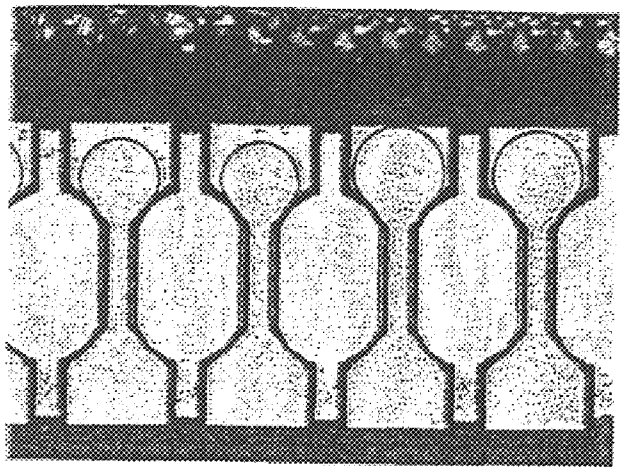

Preferred embodiments of the present invention will now be described referring to the attached figures.

In the microchannel apparatus according to the present invention, a microchannel 1 is formed between adjacent convex portions 2 defined on a surface of a base 13, which convex portions 2 are formed on a terrace 3 which is also defined by the surface of the base as a boundary section between a continuous phase and a dispersed phase.

A partition wall 4 is formed extending from both ends of each convex portion 2 toward the continuous phase and the dispersed phase, respectively. The partition walls 4 are parallel each other and a flow path 5 is formed between the partition walls 4. The length of the partition wall 4 as shown in the figures does not reach to the ends of the terrace 3, however, the length of the partition wall 4 is not be limited to the depicted structure and may reach to the ends of the terrace 3.

It is preferable to adopt a wet etching process with photolithography used in the process of forming integrated circuits for semiconductors as the method of forming the convex portions 2 and the partition walls 4 according to the present invention.

Figure 2:
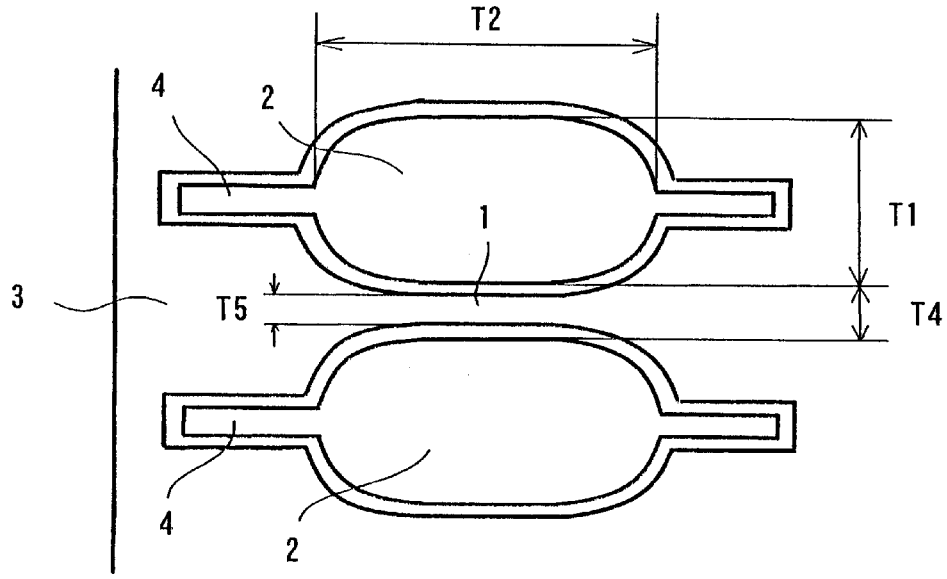
FIG. 2(*a*) is an enlarged plan view of a microchannel of FIG. 1*a* and FIG. 2(*b*) is an enlarged cross-sectional side view of a microchannel of FIG. 1*a;*
Figure 2:
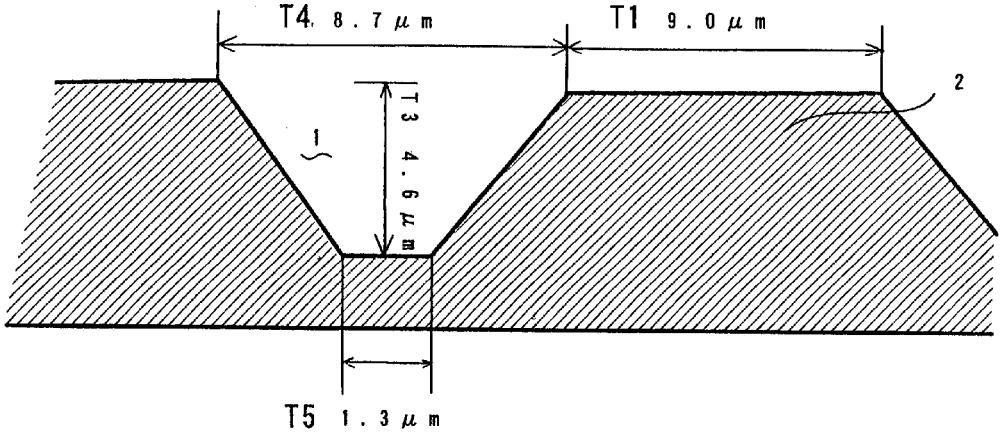
Figure 3:
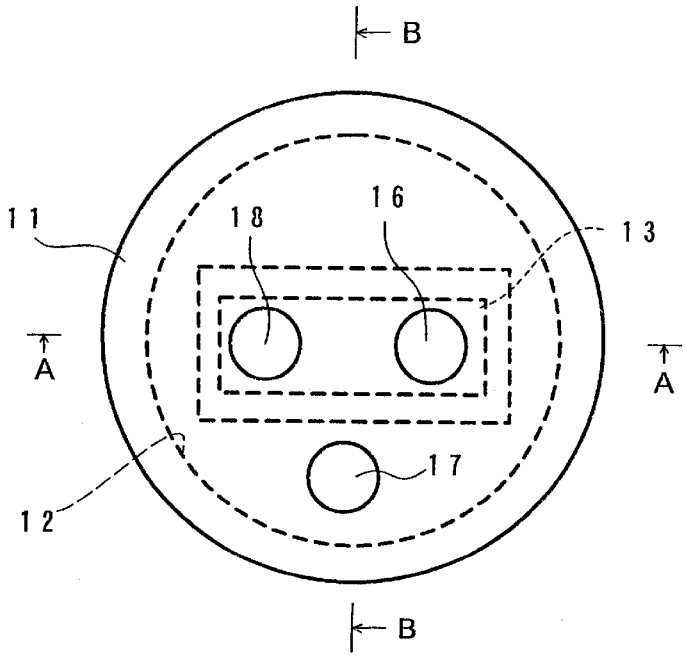
FIG. 3 is a plan view of a cross-flow microchannel apparatus according to a preferred embodiment of the present invention.

To put it concretely with regard to the size of the microchannel 1 and the convex portion 2, for example, the width of the convex portion 2 (T1) is about 9 $\mu$m, the length thereof (T2) is about 20 $\mu$m and the height thereof (T3) is about 4.6 $\mu$m, and the upper width of the microchannel 1 (T4) is about 8.7 $\mu$m and the bottom width thereof (T5) is about 1.3 $\mu$m (see FIGS. 2(*a*), 2(*b*)).

However, the form and size of the convex portion and the microchannel described above is one example only and the invention should not be limited to this.

In the cross-flow microchannel apparatus according to the present invention, as shown in FIG. 3–7, a concave portion 12 is formed in a side of a case 11, a base 13 is placed in the concave portion 12, a flow path 14 is formed in the base 13 and the side of the base to which the concave portion 12 and the flow path 14 formed in the base 13 open is covered with a plate 15, such as a glass plate or the like, in order that liquid cannot escape.

Figure 4:
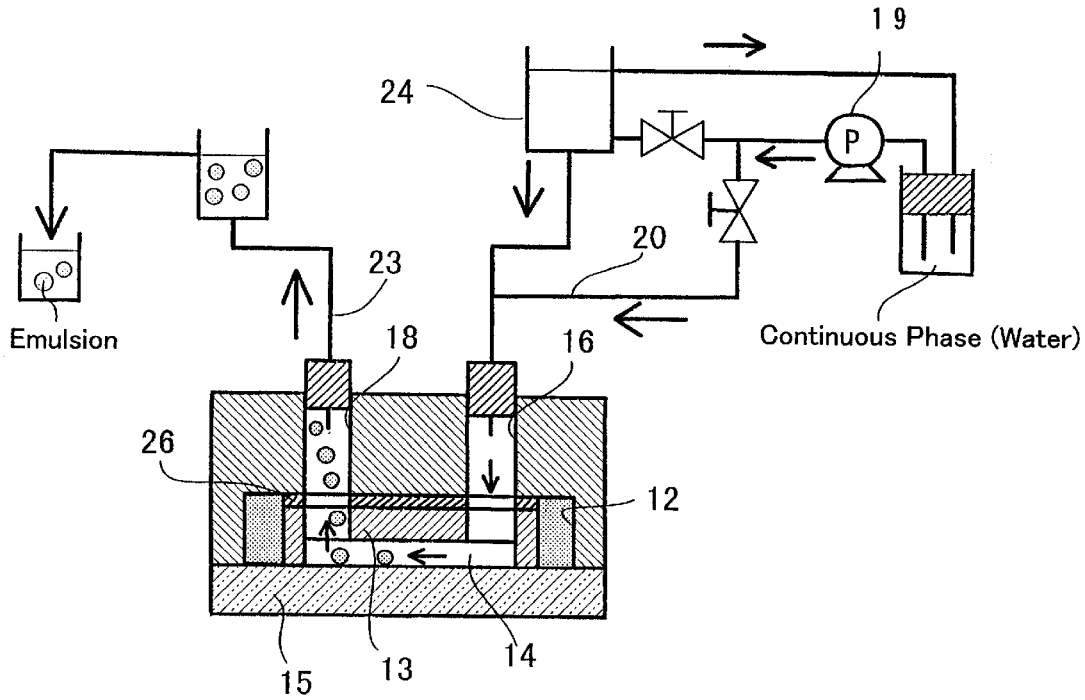
FIG. 4 is a cross-sectional view taken along line A—A shown in FIG. 3.
Figure 5:
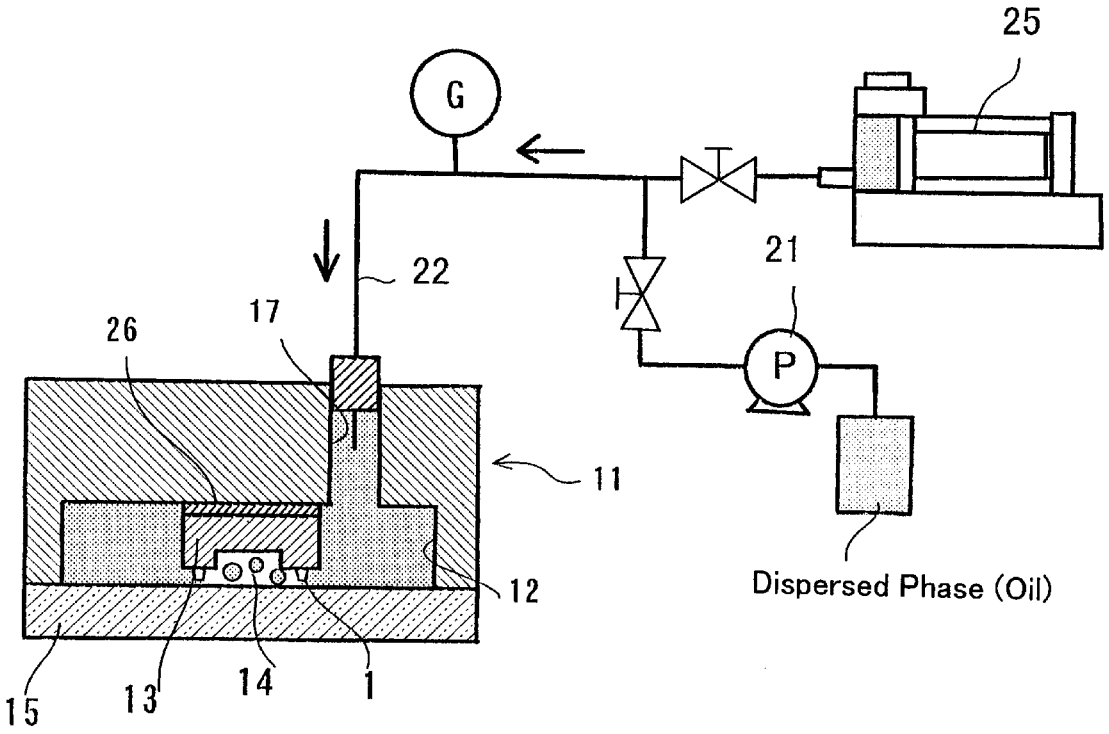
FIG. 5 is a cross-sectional view taken along line B—B shown in FIG. 3.

As shown in FIGS. 4 and 5, a supply hole 16 for a continuous phase, a supply hole 17 for a dispersed phase, and a withdrawal hole 18 for emulsions are formed in the top side of the case 11, when the apparatus is to be used in producing emulsions. A supply pipe 20 for the continuous phase (water) equipped with a pump 19 is connected to the supply hole 16, a supply pipe 22 for the dispersed phase (oil) equipped with a pump 21 is connected to the supply hole 17, and a withdrawal pipe 23 for emulsions is connected to the withdrawal hole 18.

A reservoir 24 is provided in the course of supplying the continuous phase, so as to supply the continuous phase at a predetermined pressure. A microfeeder 25 (FIG. 5) is provided in relation to the pipe 22 for supplying the dispersed phase, so as to adjust the rate of supply of the dispersed phase.

The base 13 is placed so that the flow path 14 opposes the plate 15. The base 13 is flexibly pushed onto the side of the plate 15 via a sheet 26, comprising silicon rubber, which stands between the base 13 and the inside of the case 11 in order to block the flow path 14 with the plate 15, so as to prevent liquid from escaping.

Figure 6:
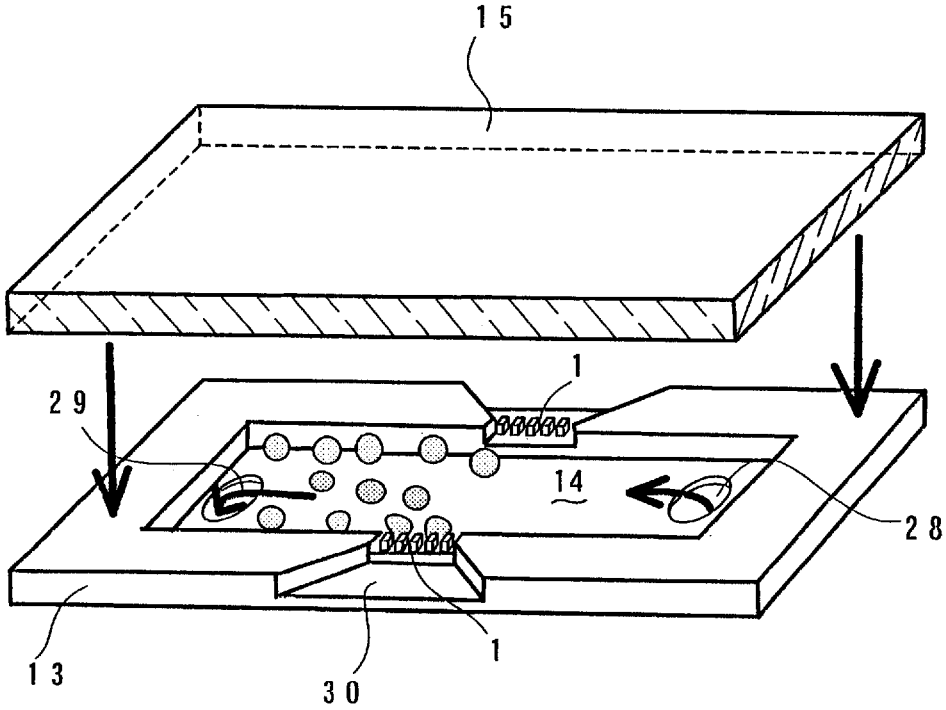
FIG. 6 shows a base and a plate taken apart, which comprise portions of the microchannel apparatus in FIG. 3.

As shown in FIG. 6, a supply port 28 for the continuous phase corresponding to the supply hole 16 is formed in the base 13 near an end of the flow path 14, and a withdrawal port 29 for emulsions corresponding to the withdrawal hole 18 is formed in the base at the other end of the flow path 14. The supply, port 28 is connected to the supply hole 16 via an opening formed in the sheet 26, and the withdrawal port 29 is connected to the withdrawal hole 18 via another opening formed in the sheet 26.

Therefore, the continuous phase flows in the flow path 14 formed in the base 13, and the dispersed phase is pumped under pressure between the outside of the base 13 and the inside of the concave portion 12 in the case 11.

In addition, one or more taper-like notches 30 is formed in a side of the base 13, wherein the notch 30 gradually becomes narrow toward the inside of the base 13. Microchannels 1 shown in FIG. 1 and FIG. 2 are formed in the narrowest part of the notch 30.

According to the present invention, there is provided a method of producing emulsions making use of the above-mentioned apparatus, comprising the steps of driving the pump 19 and the pump 21, for thereby supplying the continuous phase to the flow path 14 via supply pipe 20, the supply hole 16 and the supply port 28, and supplying the dispersed phase to a space between the outside of the base 13 and the inside of the concave portion 12 formed in the case 11 via the supply pipe 22 and the supply hole 17.

Here, the dispersed phase grows to comprise microspheres (fine particles) due to the effect of the microchannels 1 by applying a certain pressure to the dispersed phase, and the fine particles are mixed with the continuous phase, so as to produce emulsions. These emulsions are withdrawn to a tank and so on via the withdrawal port 29, the withdrawal hole 18 and the withdrawal pipe 23.

Here, in the present invention, a partition wall 4 is formed with each convex portion 2 and extends in a direction of the microchannel 1 toward the continuous phase and the flow path 5 is formed between an adjacent pair of the partition walls 4 and 4. Accordingly, as shown in FIG. 1, the dispersed phase pumped into the continuous phase via each microchannel 1 generates nearly perfect spheres in the course of passing through the flow path 5 between the partition walls 4.

Therefore, the thus formed microspheres which are substantially perfect spheres repulse each other and are difficult to unite with each other, and emulsions comprising homogenous and fine microspheres and the continuous phase can be obtained using the apparatus of the invention.

On the other hand, there is also provided a method of separating emulsions making use of the above-mentioned apparatus according to the invention, comprising the steps of connecting a supply pipe for emulsions to the supply hole 16, connecting a withdrawal pipe for a continuous phase separated from the emulsion to the supply hole 17, connecting a withdrawal pipe for a dispersed phase separated from the emulsions or for emulsions to the withdrawal hole 18, and pumping and mixing the pressurized emulsions via a pump into the flow path 14 formed in the base 13. Here, only the continuous phase is withdrawn through the microchannels 1, or only those dispersed phase particles having a diameter that is smaller than the width of the microchannels and the continuous phase are made to penetrate through the microchannels and are then withdrawn. The dispersed phase particles whose particle diameter is larger than the width of the microchannels or emulsions which contain the dispersed phase whose particle diameter is large are then withdrawn from the withdrawal pipe for dispersed phases or emulsions.

Figure 7:
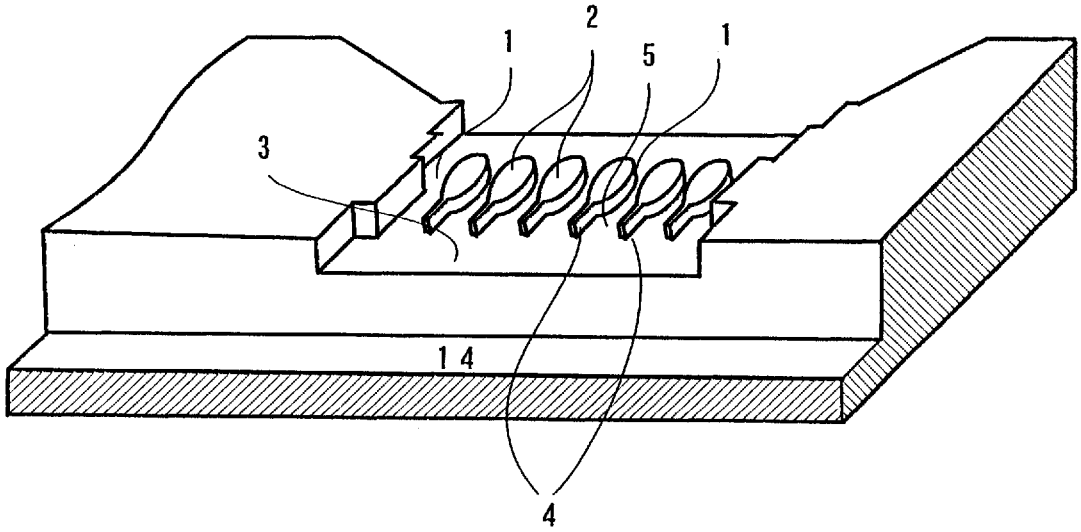
FIG. 7 is an enlarged perspective view of microchannels formed in a base according to another preferred embodiment of the invention, wherein the microchannels have a somewhat different shape in comparison to FIGS. 1(*a*), 1(*b*) and 2.
Figure 8:
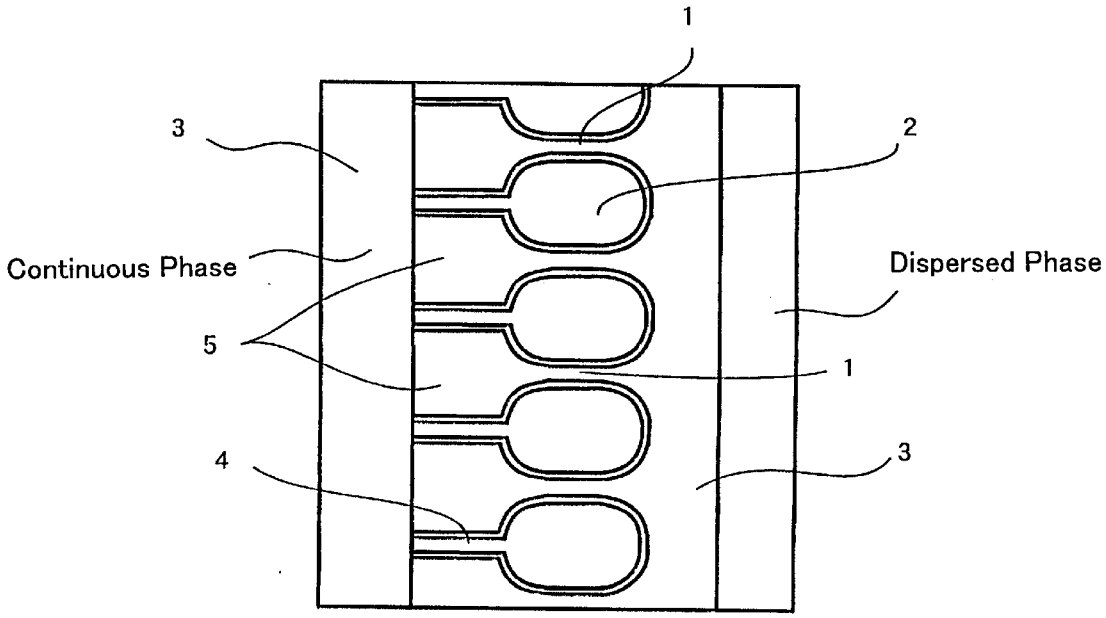
FIG. 8 is an enlarged plan view similar to FIG. 1(*a*) of the microchannels of FIG. 7.
Figure 9:
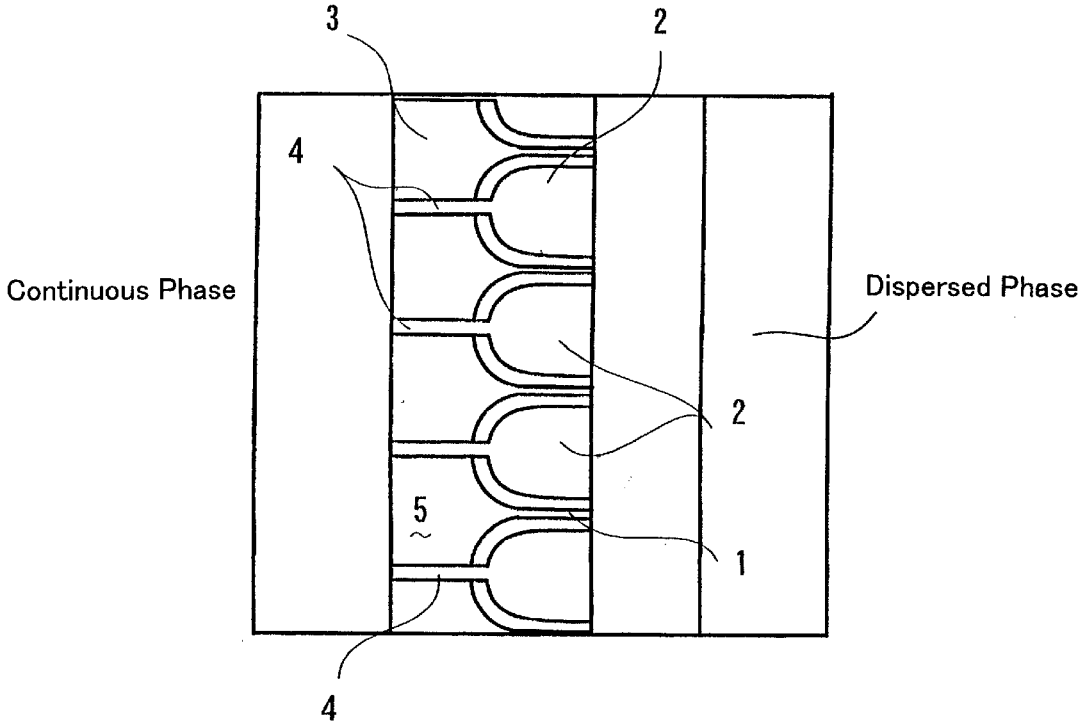
FIG. 9 is an enlarged plan view similar to FIG. 1(*a*) of yet another example of the microchannels.

In the embodiment shown in FIGS. 7 and 8, a partition wall is not formed extending from the convex portions 2 on the terrace 3 on the side of the dispersed phase, but a partition wall 4 is formed to extend from each convex portion only on the terrace 3 on the side of the continuous phase. In the embodiment shown in FIG. 9, the form of the convex portion 2 which divides the microchannels 1 is not ellipse-like or spindle-like from a plain view as shown in FIGS. 1(*a*), 1(*b*), 2, 7 and 8 but the form of the convex portion 2 on the side of the dispersed phase is in a substantially straight edge.

Figure 10:
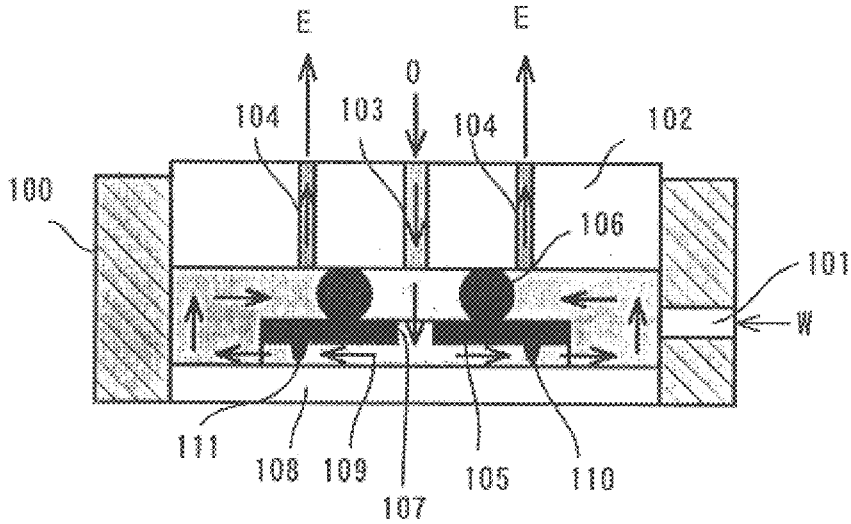
FIG. 10 is a vertical section of the conventional microchannel apparatus according to another preferred embodiment of the invention.
Figure 11:
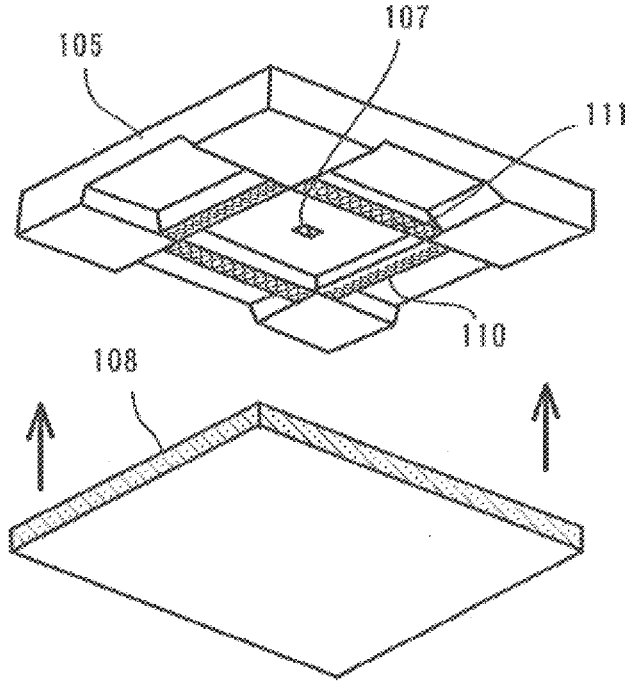
FIG. 11 shows a base and a plate taken apart in the apparatus shown in FIG. 10 previously proposed by the inventors in International Publication No. WO97/30783.
Figure 12:
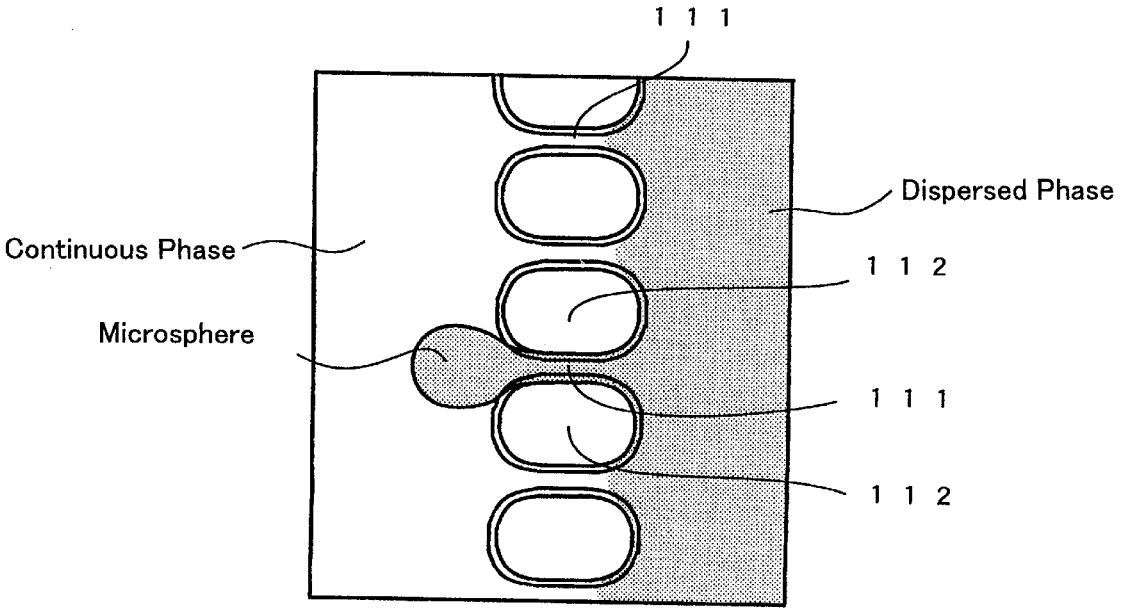
FIG. 12 shows the situation where a microsphere is produced from one conventional microchannel in the apparatus of FIG. 10.
Figure 13:
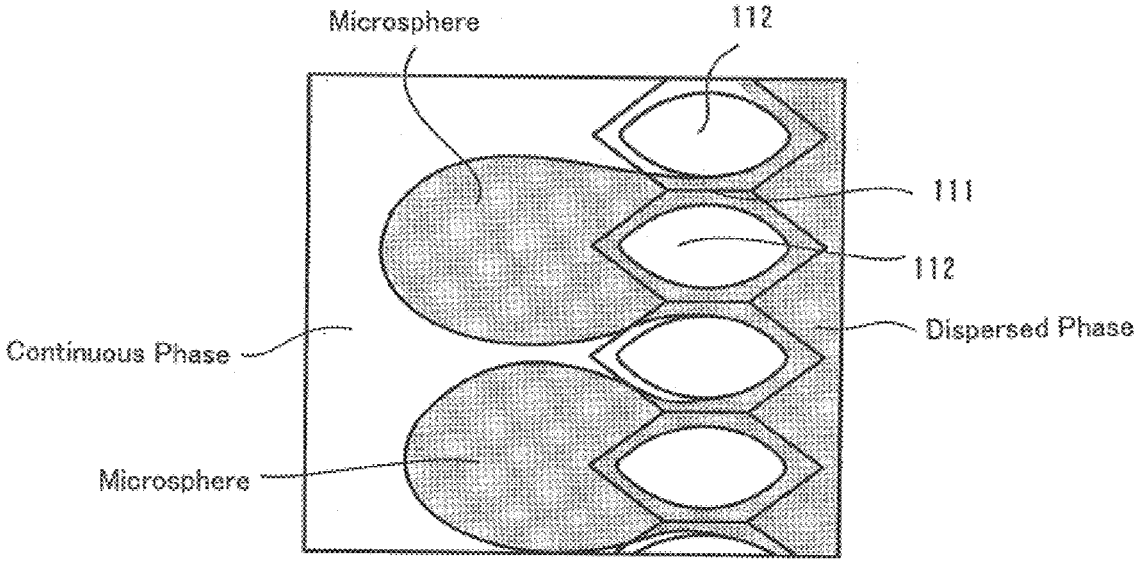
FIG. 13(*a*) is a plan view of a representation of the situation where microspheres produced in the conventional microchannel unite with each other and FIG. 13(*b*) is an enlarged photograph on which FIG. 13(*a*) is based.
Figure 13:
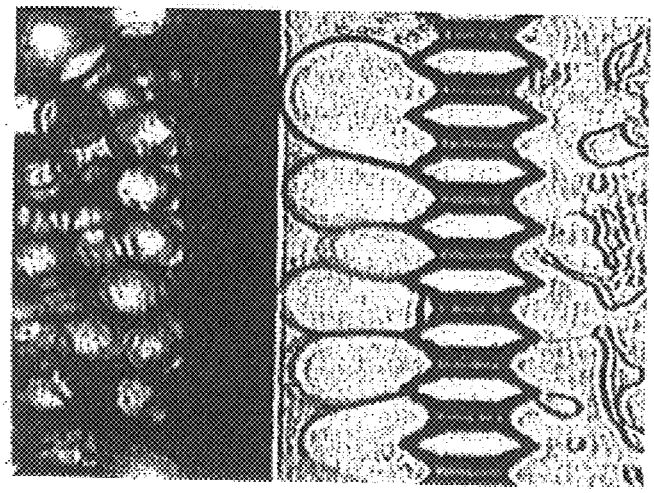

The above-mentioned microchannels, the subject of the present invention, can be applied not only to a cross-flow microchannel apparatus as described in relation to FIGS. 3–6, but also to the conventional microchannel apparatus shown in FIG. 10. In addition, they can be applied to a microchannel apparatus which withdraws emulsions by orienting the conventional microchannel apparatus shown in FIG. 10 in a vertical direction and otherwise rearranges the directions of flow of the emulsion, dispersed phase and continuous phase so as to use differences in specific gravity between the dispersed phase and the continuous phase to facilitate production of the emulsion.

As described above, according to the microchannel apparatus of the present invention, since a partition wall is formed to effectively extend the microchannels in which microspheres are produced, the microspheres formed in the adjacent microchannels do not unite with each other and the microspheres become nearly perfect spheres, and thereby fine and homogenous microspheres (emulsions) can be produced.

Furthermore, it is possible to increase the efficiency of production, because microspheres do not unite with each other even if all microchannels are used for producing emulsions by applying higher pressure to the dispersed phase.

Although there have been described what are at present considered to be the preferred embodiments of the invention, it will be understood by those in the art that variations and modifications may be made thereto without departing from the gist or essence of the invention. The scope of the invention is indicated by the appended claims, rather than by the foregoing description.

What is claimed is:

1. In a microchannel apparatus having a case with supply holes for supplying a dispersed phase and a continuous phase into the case, a withdrawal hole for withdrawing an emulsion of the continuous and dispersed phases from the case, and a boundary section between a dispersed phase region and a continuous phase region within the case, the microchannel apparatus, comprising:

a plurality of microchannels having a predetermined width formed in the boundary section between the dispersed phase region and the continuous phase region in which the dispersed phase is pumped into the continuous phase via said microchannels to form microspheres; wherein said microchannels are formed between fine convex portions, and a partition wall is formed from at least one of said convex portions toward the continuous phase.

2. A microchannel apparatus comprising:

a base which is accommodated in a case;

a plate which is installed on a side of said base for forming a flow path beside said base;

a plurality of microchannels having a predetermined width formed in a boundary section within said case between a dispersed phase region and a continuous phase region in which the dispersed phase is pumped into the continuous phase via said microchannels to form microspheres;

a supply hole for the continuous phase, a supply hole for the dispersed phase, and a withdrawal hole for emulsions are formed in said case;

a supply port for the continuous phase corresponding to said supply hole for the continuous phase, a withdrawal port for emulsions corresponding to said withdrawal hole for emulsions, and said microchannels are formed in said base;

said microchannels are formed in a side of the base opening to said flow path; and said microchannels are formed between fine convex portions, and a partition wall is formed from at least one of said convex portions toward the continuous phase.

3. The microchannel apparatus defined in claim 2, wherein said plate is a transparent plate.

4. The microchannel apparatus defined in claim 1, further comprising:

a base in which a supply port for the dispersed phase is formed;

a gap into which the dispersed phase may be supplied formed between said base and a plate placed opposite one side of said base; and said boundary section between the dispersed phase region and the continuous phase region is formed on an opposite side of said base; wherein said microchannels are formed in said base for feeding the dispersed phase into the continuous phase region.

5. The microchannel apparatus defined in claim 4, wherein said plate is a transparent plate.

6. The microchannel apparatus defined in claim 1, further comprising:

a base oriented in a substantially vertical direction; and a plate placed opposite to one side of said base; wherein a supply port for the dispersed phase is formed in said base, said boundary section is formed on an opposite side of said base for dividing the continuous phase region into which the continuous phase is supplied and the dispersed phase region to which the dispersed phase is supplied, and said microchannels are formed in a position from which the fine particles of the dispersed phase can be withdrawn from a withdrawal port in the apparatus by floating and sinking in response to their specific gravity.

7. The microchannel apparatus defined in claim 4, wherein said plate is a transparent plate.

8. The microchannel apparatus defined in claim 1, wherein each said convex portion has a partition wall formed therefrom toward the continuous phase.

9. The microchannel apparatus defined in claim 8, wherein flow paths are defined between adjacent ones of said partition walls, said flow paths extending axially from said microchannels, respectively, and having a greater width than said microchannels.

10. The microchannel apparatus defined in claim 9, wherein said flow paths have a sufficiently long length that after the dispersed phase emerges from the microchannels it generates nearly perfect spheres as it passes through the flow paths.

11. The microchannel apparatus defined in claim 8, wherein each said convex portion also has another partition wall formed therefrom toward the dispersed phase.

12. The microchannel apparatus defined in claim 1, wherein said at least one convex portion also has another partition wall formed therefrom toward the dispersed phase.

13. A method of producing emulsions, comprising step of:

feeding a pressurized dispersed phase into a continuous phase via a plurality of microchannels separated by partition walls, said microchannels having a predetermined width; wherein the dispersed phase is pumped into the continuous phase via each of said microchannels after the dispersed phase generates nearly perfect spheres by making the dispersed phase pass between the partition walls.

14. A method of producing emulsions as defined in claim 13, wherein said microchannels are provided in a microchannel apparatus comprising:

a base which is accommodated in a case;

a plate which is installed on a side of said base for forming a flow path beside said base;

a supply hole for the continuous phase, a supply hole for the dispersed phase, and a withdrawal hole for emulsions are formed in said case;

a supply port for the continuous phase corresponding to said supply hole for the continuous phase, a withdrawal port for emulsions corresponding to said withdrawal hole for emulsions, and said microchannels are formed in said base;

said plurality of microchannels are formed in a boundary section within said case between a dispersed phase region and a continuous phase region in which the dispersed phase is pumped into the continuous phase via said microchannels to form said microspheres;

said microchannels are formed in a side of the base opening to said flow path, between fine convex portions, and said partition walls are formed from at least one of said convex portions toward the continuous phase.

* * * * *

UNITED STATES PATENT AND TRADEMARK OFFICE

CERTIFICATE OF CORRECTION

PATENT NO. : 6,281,254 B1 
DATED : August 28, 2001
INVENTOR(S) : M. Nakajima, H. Nabetani, Y. Kikuchi and C. Largueze It is certified that error appears in the above-identified patent and that said Letters Patent is hereby corrected as shown below:

Title page,
Item [56], References Cited, further under FOREIGN PATENT DOCUMENTS, for reference number 9-225291, change the document date from "2/1997" to -- 9/1997 --;
Item [74], *Attorney, Agent or Firm*, change "Jpseph P. Carrier" to -- Joseph P. Carrier --;
Item [57], ABSTRACT,
Line 1, change "a plural" to -- plural --.

Column 2,
Line 3, delete "a";
Line 48, delete "of the base,".

Column 3,
Line 8, change "region phase" to -- phase region --;
Line 13, change "portions" to -- portion --;
Line 23, change "in above" to -- above --.

Column 4,
Line 5, change "shaving," to -- shaving of the base, --;
Line 8, delete "of the base";
Line 37, before the semicolon insert -- according to another preferred embodiment of the invention --;
Lines 39-40, change "according to another preferred embodiment of the invention" to -- previously proposed by the inventors in International Publication No. WO97/30783 --;
Lines 42-43, change "previously proposed by the inventors in International Publication No. WO97/30783:" to a semicolon.

UNITED STATES PATENT AND TRADEMARK OFFICE

CERTIFICATE OF CORRECTION

PATENT NO. : 6,281,254 B1 
DATED : August 28, 2001
INVENTOR(S) : M. Nakajima, H. Nabetani, Y. Kikuchi and C. Largueze It is certified that error appears in the above-identified patent and that said Letters Patent is hereby corrected as shown below:

Column 5,
Line 2, delete "be";
Line 57, after "supply" delete the comma.

Column 8,
Line 35, change "4" to -- 6 --.

Signed and Sealed this

Twenty-third Day of July, 2002

*Attest:*

*Attesting Officer*

JAMES E. ROGAN
*Director of the United States Patent and Trademark Office*